United States Patent [19]

Inger

[11] 4,280,322

[45] Jul. 28, 1981

[54] TEXTILE YARN PROCESSING MACHINE WITH YARN BREAK MONITORING MECHANISM

[75] Inventor: Siegfried Inger, Krefeld, Fed. Rep. of Germany

[73] Assignee: Palitex Project Company GmbH, Krefeld, Fed. Rep. of Germany

[21] Appl. No.: 61,390

[22] Filed: Jul. 27, 1979

[30] Foreign Application Priority Data

Jul. 27, 1978 [DE] Fed. Rep. of Germany ..... 2832930

[51] Int. Cl.[3] ..... D01H 13/16; D01H 1/10

[52] U.S. Cl. ..... 57/81; 57/279

[58] Field of Search ..... 57/80, 81, 58.49, 58.83, 57/58.86, 279, 280

[56] References Cited

U.S. PATENT DOCUMENTS

| | | | |
|---|---|---|---|
| 3,701,247 | 10/1972 | Rehn et al. | 57/81 |
| 3,805,507 | 4/1974 | Steppuhn | 57/81 |
| 3,945,183 | 3/1976 | Landwehrkamp et al. | 57/81 X |
| 3,968,637 | 7/1976 | van Andel et al. | 57/81 |
| 3,981,134 | 9/1976 | Heimes | 57/81 |
| 4,033,107 | 7/1977 | Sasayama et al. | 57/81 |

FOREIGN PATENT DOCUMENTS 2701635 10/1977 Fed. Rep. of Germany .

*Primary Examiner*—John Petrakes

*Attorney, Agent, or Firm*—Bell, Seltzer, Park and Gibson

[57] ABSTRACT

A textile yarn processing machine, such as a two-for-one twister or the like, having respective yarn processing stations is provided with an improved yarn monitoring system for stopping the operation of the yarn processing station in response to the absence of a yarn running therethrough, as for example, upon the occurrence of a yarn breakage. The improved yarn monitoring system of the present invention is constructed generally as follows: A yarn sensor is constructed and mounted so as to be held in an operative setting by yarn tension when the yarn is running in normal operating condition and to be released in the event of the release of such tension, as upon a yarn breakage. A switching mechanism is provided for stopping the operation of the yarn processing station, and means is provided for operably connecting the yarn sensor to the switching mechanism for actuating the switching mechanism upon the release of the yarn sensor from its operative setting. These devices cooperate with a time delay means which is actuable upon restarting the yarn processing station for permitting a further actuation of the switching mechanism only after a predetermined period of time has elapsed to thus allow the yarn processing station to resume a normal, stabilized operating condition and to thereby avoid inadvertent and undesirable actuation of the switching mechanism prior to the yarn processing station reaching such a stabilized operating condition.

20 Claims, 10 Drawing Figures

TEXTILE YARN PROCESSING MACHINE WITH YARN BREAK MONITORING MECHANISM

FIELD OF THE INVENTION

This invention relates to a textile yarn processing machine, such as a two-for-one twister, having a mechanism for monitoring the running yarn to detect, for example, the occurrence of yarn breakage. The invention more particularly relates to a textile yarn processing machine of the type in which a rotating balloon of yarn is formed during the processing operation, and wherein a yarn sensor is arranged in the zone of the rotating yarn balloon, the sensor being held in an operative setting by the tension of the running yarn and being released upon the absence of such tension, as in the event of yarn breakage, to actuate a switching mechanism controlling the operation of the yarn processing machine.

BACKGROUND OF THE INVENTION

In a textile yarn processing machine, particularly a two-for-one twister, it is desirable and has been the practice in some machines to provide a monitoring mechanism of the type generally described above for monitoring or sensing the presence of a running yarn in the yarn processing station and for controlling certain aspects of the operation of the textile machine, as for example by stopping the machine or the particular yarn processing station in the event of a yarn breakage.

In textile yarn processing machines, such as two-for-one twisters, in which the running yarn forms a rotating balloon of yarn during such processing, the yarn sensor is commonly associated with the yarn guide eyelet conventionally provided for limiting the upper end of the rotating balloon of yarn during passage of the running yarn through such eyelet. As a result of centrifugal forces acting on the yarn by the rotating balloon of such yarn, a tension is created in the yarn in the zone of the rotating balloon of such yarn, which is also assisted by tension forces acting in the direction of travel of the yarn as a result of the movement of the yarn toward the take-up mechanism. These combined yarn tension forces are exerted on the yarn guide eyelet in the running direction of the yarn and may be utilized for yarn monitoring or sensing purposes to hold a yarn sensor in an operative setting when the yarn is running and for releasing the yarn sensor in the event of yarn breakage to actuate a switching mechanism controlling the operation of the machine.

As disclosed, for example, in U.S. Pat. No. 3,981,134, issued Sept. 21, 1976 and assigned to the assignee of the present invention, the yarn guide eyelet is mounted to the machine frame for pivotal upward or downward movement under the influence of the forces exerted on the yarn guide eyelet by the yarn running therethrough. During normal operation, the yarn tension holds the yarn guide eyelet upwardly in an operative setting. However, in the event of the absence of such tension, as upon a yarn breakage or the absence of a running yarn, the yarn guide eyelet swivels downwardly about a horizontal axis and engages an electrical microswitch which serves for triggering a switching mechanism and stopping the operation of certain mechanisms in the yarn processing station.

After the yarn has been threaded in and the yarn processing station restarted, the yarn tension forces will be restored and the yarn guide eyelet will be moved back upwardly to its operative setting, as a result of which the microswitch will be released and returned to a setting in which it is again ready for sensing a yarn breakage.

A particular problem in the operation of the yarn sensor mechanism frequently occurs at this time. Upon restarting of the yarn processing station, the yarn tension required for maintaining the yarn sensor in its operative setting is not built up instantaneously, but gradually as the moving elements, such as the rotating spindle and the take-up assembly, return to normal operating speed from a stopped condition. During this gradual build-up of the yarn tension, the yarn sensor may sometimes move for a short period back into its nonoperative or released setting, and as a result may trigger the stopping of the yarn processing station as though a yarn breakage had occurred.

It has therefore been necessary, in order to avoid this inadvertent and undesirable tripping of the switching mechanism, for the yarn sensor mechanism to be very delicately tuned or adjusted to the build-up of the yarn tension, and this has necessitated frequent maintenance in order to maintain the yarn sensor mechanism in proper adjustment. This problem is particularly troublesome where the yarn sensor mechanism employs an electrical switch, as in the above-mentioned United States patent or as in the arrangement shown in German Offenlegungsschrift 2,024,122.

SUMMARY OF THE INVENTION

With the foregoing in mind it is an important object of the present invention to provide in a yarn processing machine of the type described an improved yarn monitoring mechanism which is particularly constructed to avoid inadvertent and undesirable actuation of the switching mechanism upon restarting of the yarn processing station.

In accordance with the invention there is provided in a textile yarn processing machine, such as a two-for-one twister or the like, having respective yarn processing stations, an improved yarn monitoring system for stopping the operation of the yarn processing station in response to the absence of a yarn running therethrough, as for example, upon the occurrence of a yarn breakage, and which is constructed to avoid inadvertent and undesirable stopping of the yarn processing station upon restarting while the yarn processing station is returning to a normal stabilized operating condition.

The improved yarn monitoring system of the present invention is constructed generally as follows :

A yarn sensor is constructed and mounted so as to be held in an operative setting by yarn tension when the yarn is running in normal operating condition and to be released in the event of the release of such tension, as upon a yarn breakage. A switching mechanism is provided for stopping the operation of the yarn processing station, and means is provided for operably connecting the yarn sensor to the switching mechanism for actuating the switching mechanism upon the release of the yarn sensor from its operative setting. These devices cooperate with a time delay means which is actuable upon restarting the yarn processing station for permitting a further actuation of the switching mechanism only after a predetermined period of time has elapsed to thus allow the yarn processing station to resume a normal stabilized operating condition and to thereby avoid inadvertent and undesirable actuation of the switching mechanism prior to the yarn processing station reaching such a stabilized operating condition.

In a yarn processing machine such as a two-for-one twister in which a rotating balloon of yarn is formed during the processing of the yarn and a yarn guide eyelet is provided for limiting the upper end of the balloon of yarn during passage of a yarn therethrough, the yarn sensor may conveniently be associated with the yarn guide eyelet and constructed so as to be held in an operative setting by the tension of the yarn running through the eyelet and to be released in the event of the release of such tension. However, it will be understood that the yarn sensor could also be constructed and arranged for sensing the tension of the yarn at other locations in the yarn processing station.

In accordance with the operation of the apparatus of the present invention, when a yarn breakage occurs, the yarn sensor moves from its operative setting into a released setting in which it actuates the switching mechanism, which in turn can control various consequential events, such as for example recording the occurrence of the yarn breakage, sounding an alarm to alert the operator of the yarn processing machine, and stopping the machine or the particular yarn processing station involved. In the case of a two-for-one twister yarn processing machine, for example, the switching mechanism may be utilized for actuating a spindle stopping device, a spindle brake, and for stopping the take-up mechanism.

In order to restore the yarn processing station to operation, various servicing operations are carried out, for example, replacing the yarn supply package, threading the yarn through the spindle assembly and to the take-up mechanism, etc. As these servicing operations are carried out, it is normally impossible to prevent the yarn sensor from moving between its normally operative setting and its inoperative setting. When the servicing operations are completed and the yarn processing station is restarted, the yarn tension, as noted earlier, builds gradually and during this time the yarn tension may not be adequate to maintain the yarn sensor in its normal operative setting.

In accordance with the present invention, a time delay means is provided which is operable for interrupting or overriding the operative connection between the yarn sensor and the switching mechanism controlling the stopping of the yarn processing station, this interruption or overriding lasting for a predetermined period of time sufficient for the yarn processing machine to return to a normal stabilized operating condition wherein the yarn tension is adequate to maintain the yarn sensor in its proper operative setting. Thus, upon restarting of the yarn processing machine, further actuation of the switching mechanism is prevented until this predetermined period of time has elapsed. The time delay means preferably comprises a pressure reservoir having a restricted bleed opening for allowing the pressure level therein to slowly drop over a predetermined period of time, with means being provided associated with this pressure reservoir for interrupting the operative connection of the yarn sensor to the switching mechanism until the pressur level in the pressure reservoir has dropped to a predetermined level.

In accordance with one embodiment of the invention, as illustrated and described more fully hereinafter, there is associated with the yarn sensor a pressure outlet connected to a pressure source, the pressure outlet cooperating with the yarn sensor so that the outlet is blocked when the yarn sensor is in its normal operative setting, and open when the yarn sensor moves to the released setting. In response to the movement of the yarn sensor from the operative setting to the released setting upon a yarn breakage, the resulting blocking of the pressure outlet is used to pneumatically actuate the switching mechanism for thus stopping the operation of the yarn processing station.

In a system of this kind, the compressed air outlet will be open only during a limited period of time, namely, while the necessary servicing operations are being carried out. In the event that these servicing operations are not immediately carried out, or are unsuccessful and it is necessary to repeat the servicing operation in order to restore the yarn processing station to operation, this system or arrangement permits the servicing operations to be repeated as many times and as frequently as necessary, without the need for waiting for a predetermined working cycle or pneumatic recycle time.

There has previously been described in German Pat. No. 2,701,635, a yarn sensor mechanism for a two-for-one twisting spindle wherein a pressure outlet cooperates with a yarn sensor for the purpose of pneumatically controlling the operation of the twisting station. However, this prior publication is not concerned with a time delay mechanism as employed in the present invention wherein the yarn sensor is temporarily isolated from the switching mechanism to permit servicing operations to be carried out at the yarn processing station and to facilitate restarting thereof as the yarn tension gradually builds.

In another embodiment of the present invention, a pressure outlet connected to a pressure source is associated with the yarn sensor so as to be opened when the yarn sensor is in its normal operative setting, and blocked by the yarn sensor in the event of yarn breakage. In this embodiment, a small jet or air emerges from the air outlet during normal operation of the yarn processing station. When a yarn breakage occurs and the air outlet is blocked, pressure can build up in a duct system leading to the air outlet, and this pressure can be employed for actuating the switching mechanism which controls the operation of the yarn processing station.

In still another embodiment of the invention, a movable holding member is associated with the yarn sensor and is movable between a rest position out of engagement with the yarn sensor and a holding position for engaging and holding the yarn sensor in its operative setting. Means is provided for maintaining this holding member in the holding position for a predetermined period of time following the restarting of the yarn processing station, to thus prevent movement of the yarn sensor from the operative setting to the released setting and thereby prevent actuation of the switching mechanism until this predetermined period of time has elapsed.

Further features of the illustrated embodiments of the apparatus of the present invention will be seen from the following more detailed description.

BRIEF DESCRIPTION OF THE DRAWINGS

Some of the objects and advantages of the invention having been stated, other objects and advantages will appear when taken in connection with the accompanying drawings, in which.

DESCRIPTION OF ILLUSTRATED EMBODIMENTS

While the drawings and specific description to follow will be related to a two-for-one twister textile yarn processing machine, which is the preferred form of machine utilizing the improved yarn monitoring mechanism of this invention, it is to be understood that this improved mechanism could be utilized with other types of textile yarn processing machines for which monitoring of the yarn and operation of control mechanisms is desired.

Figure 1:
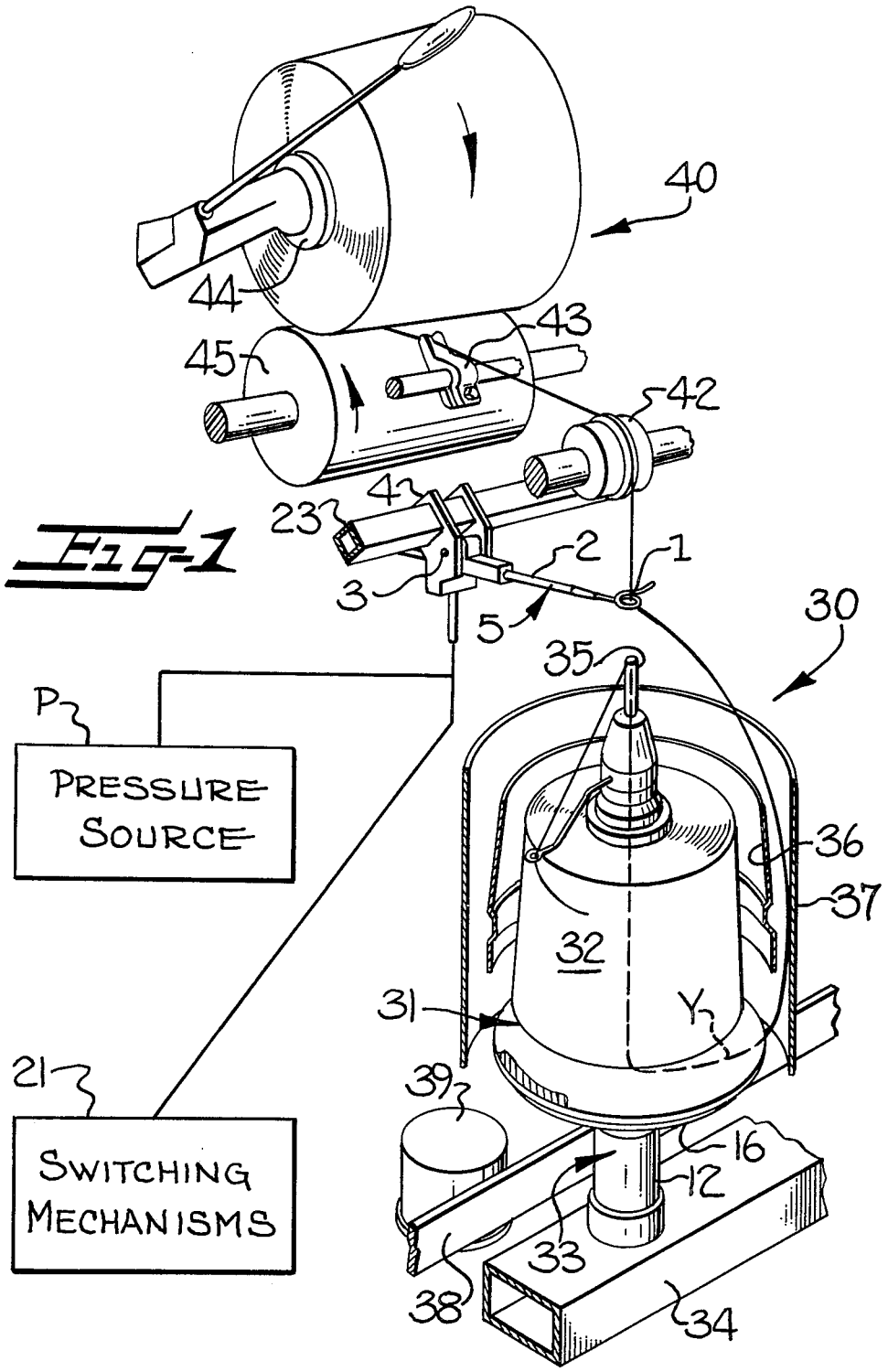
FIG. 1 is a schematic perspective view, partially broken away, illustrating one yarn processing station of a two-for-one twister textile yarn processing machine utilizing the improved yarn monitoring mechanism of this invention.

Referring now to the drawings, there is illustrated in FIG. 1 a schematic view of one yarn processing station of a two-for-one twister textile yarn processing machine. It is to be understood that a plurality of these yarn processing stations are provided in generally side-by-side relationship in two rows along the outside of the yarn processing machine. A full illustration and description of the entire two-for-one twister textile yarn processing machine is not given herein and is not believed to be necessary for an understanding of the present invention, the operation and structure of such a two-for-one twister textile yarn processing machine being well understood by those with orindary skill in the art.

Generally, each of the yarn processing stations of the two-for-one twister textile yarn processing machine includes a spindle assembly, generally indicated at 30, having a stationary carrier mechanism 31 on which a hollow supply package 32 of yarn Y is mounted. The spindle assembly further includes a rotor mechanism 33 which is mounted to the machine frame 34 and constructed for rotation relative to the stationary carrier mechanism 31. The carrier mechanism 31 further includes a hollow yarn entry tube 35 extending axially through the yarn package 32 and providing a passageway for the yarn therethrough. The yarn passageway of the yarn entry tube 35 communicates with a yarn passageway in the rotatable rotor mechanism for providing an elongate passageway extending axially through the yarn package and radially outwardly beneath the base of the package 32, along the path generally indicated by the broken lines in FIG. 1. The carrier mechanism further includes a basket device 36 surrounding the yarn supply package 32 and a balloon limitor device 37 surrounding the basket device 36. The rotor mechanism 33 is rotatably driven by a drive belt 38 which is held in selective engagement therewith by a roll 39 in a known manner.

When the yarn Y is threaded through the spindle assembly in the manner illustrated and the rotor mechanism 33 is rotated, the yarn Y is drawn from the yarn package 32 and passes downwardly into the yarn entry tube 35 and through the yarn passageway, emerging from the rotor mechanism and forming a rotating balloon of yarn between the basket device 36 and the balloon limitor 37. The yarn is directed through a yarn guide eyelet 1 located above the spindle assembly 30 for limiting the upper end of the rotating balloon of yarn as the yarn passes therethrough. After passing through the yarn guide eyelet 1, the yarn is directed to a take-up mechanism for the yarn processing station, generally indicated by the reference character 40, and including a pretake-up roll 42, a traversing mechanism 43, a package roll device 44 for forming a package of the processed yarn Y, and which is rotatably driven by friction drive roll 45.

In accordance with the present invention, a yarn sensor mechanism, generally indicated by the reference character 5, is provided at each yarn processing station for operating a switching mechanism, broadly and schematically indicated in FIG. 1 at 21, in response to the absence or presence of yarn Y running through the yarn guide eyelet 1. The switching mechanism 21 may control conventional start motion devices, stop motion devices, alarms, such as lamps, bells, etc., devices for recording the occurrence of a yarn breakage, or other control mechanisms for stopping or indicating the need for stopping the particular yarn processing station or the entire yarn processing machine. The yarn sensor mechanism 5 is operatively associated with the yarn guide eyelet 1 and is mounted by a holder 4 to a stationary member 23 forming a part of the yarn processing machine frame. The yarn sensor 5 includes a shaft or holding rod 2 to which the yarn guide eyelet 1 is connected, and which is mounted for pivotal movement in a vertical direction about a horizontally extending pivot shaft 3 supported by the holder 4. When the yarn is running, the yarn tension which is exerted upwardly on the yarn guide eyelet 1 holds the shaft 2 of the yarn sensor mechanism 5 in an operative setting extending substantially horizontally as shown in FIGS. 2, 3, 7, 8 and 9. In the absence of yarn tension, as for example, when a yarn breakage occurs or the supply yarn package is exhausted, the shaft 2 is released and pivots downwardly, with the yarn sensor mechanism 5 thus moving from its operative setting to a released setting.

Figure 2:
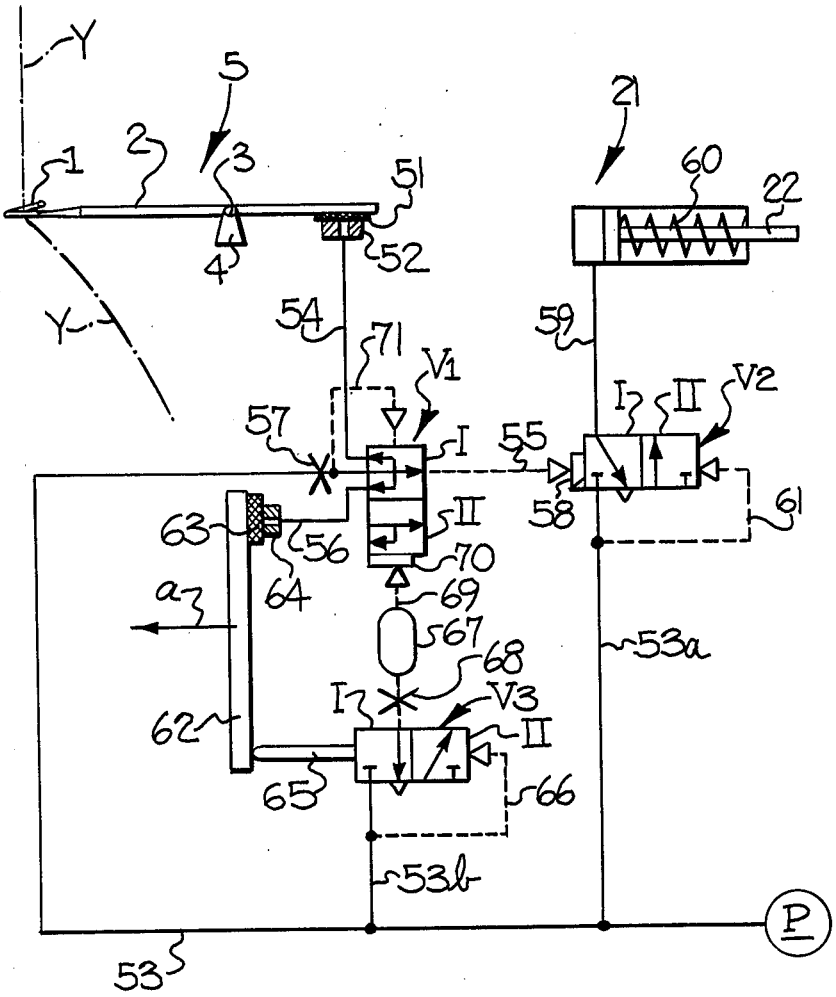
FIG. 2 is a schematic drawing of a yarn monitoring mechanism constructed in accordance with a first embodiment of the invention and showing a yarn sensor associated with a yarn guide eyelet of a two-for-one twister yarn processing station, and an associated control circuit.

In accordance with a first embodiment of the invention, as illustrated schematically in FIG. 2 and in somewhat more detail in FIGS. 3–6, a seal 51 is carried by the yarn sensor 5. When the yarn sensor is in its operative setting, the seal 51 engages and blocks a pressure outlet 52 to which compressed air is supplied from a compressed air source P through lines 53, 54 when a multiway valve $V_1$ occupies a switching setting I, as shown in FIG. 2. In this switching setting (I) of the multiway valve $V_1$, compressed air is also supplied to pressure lines 55 and 56. A throttle or restrictor member 57 is located in the line 53 on the input side of the multiway valve $V_1$. The compressed air in the line 55 acts upon a larger control face 58 of a differential pressure-actuated control valve $V_2$. The control valve $V_2$ is thus maintained in the switching setting I shown in FIG. 2, in which a switching mechanism 21 in the form of a control cylinder is vented through a line 59, so that a piston rod 22 occupies, under the influence of a restoring spring 60, a retracted setting in the control cylinder. Pressure from the compressed air pressure source P also acts, through a branch line 53*a* and a connecting line 61, upon a smaller control face opposite the larger control face 58 of the control valve $V_2$. However, because of the differential in size of the control faces, the pressure applied to the smaller control face through the line 61 is not sufficient to move the control valve $V_2$ out of the switching setting I shown in FIG. 2 so long as pressure is applied to the larger control face 58.

When the tension on the yarn Y becomes sufficiently low or ceases to exist altogether, as for example upon the occurrence of a yarn breakage, the air outlet 52 will be opened. This causes the pressure in the control line 55 to fall so that the control valve $V_2$ is reset into a switching setting II by the compressed air supplied through the line 61 and acting upon the smaller control face of the valve $V_2$. In this switching setting (II), the branch line 53*a* from the pressure source P is connected to the line 59 and the pressure chamber of the switching mechanism 21 is pressurized so that the piston rod 22 is moved outwardly. The piston rod 22 can, through suitable mechanical or pneumatic mechanisms (not shown), act upon control elements or devices controlling certain aspects of the operation of the yarn processing station. In the case of a two-for-one twisting spindle, for example, the piston rod 22 may actuate a spindle stopping device, a spindle brake, a friction drive roll brake, or the like.

Subsequently, in preparation for restarting the yarn processing station, a mechanical switching element 62 is reset in the direction of the arrow a, either manually or by an automatic device for the reactivation of the yarn processing station, i.e. in the present case the two-for-one twisting spindle assembly. This switching element 62 carries a seal 63 which, in the normal setting of the switching element 62 as illustrated in FIG. 2, blocks or closes a second pressure outlet 64 connected to the pressure line 56. In this setting, the switching element 62 also engages a plunger 65 of a reservoir control valve $V_3$ so as to hold the valve $V_3$ in the switching setting I shown in FIG. 2 against an opposing biasing force produced by compressed air acting on a control face of the valve $V_3$ and supplied thereto through a branch line 53*b* and a connection line 66.

When the switching element 62 is actuated or released so as to be reset in the direction of the arrow a, the release of the plunger 65 causes the control valve $V_3$ to be reset into the switching setting II under the influence of the compressed air acting through the line 66 upon the control face of the control valve $V_3$. In this switching setting II a connection is made between the branch line 53*b* and a pressure reservoir 67 (FIG. 2). A throttle or restrictor element 68 is located in the line between the reservoir control valve $V_3$ and the pressure reservoir 67.

From the pressure reservoir 67 there leads a control line 69 which acts upon a larger control face 70 of the multiway valve $V_1$. This multiway valve $V_1$ had thus far been subjected to the action of compressed air in the zone of a smaller control face facing the larger control face 70 and serving to hold the valve $V_1$ in the switching setting I. Pressure is supplied to the smaller control face of the valve $V_1$ by a connecting line 71 joining with the line 53 on the downstream side of the restrictor throttle 57.

As a result of the release of the manual switching element 62 and the pressurizing of the pressure reservoir 67, the pressure acting on the larger control face 70 of the valve $V_1$ causes the valve to be reset to the switching setting II (FIG. 2), and as a result of which the compressed air supply to the pressure outlet 52 is interrupted. In the switching setting II, the multiway valve $V_1$ provides a connection among the lines 53 leading from the pressure source P, the line 55 leading to the larger control face of the differential pressure control valve $V_2$, and the line 56 leading to the second pressure outlet 64. Since the pressure outlet 64 is opened with the resetting of the switching element 62, the compressed air supplied through the restrictor 57 can escape through this outlet 64, and as a result the control line 55 continues to remain without pressure. The control valve $V_2$ thus remains in its switching setting II, with the piston rod 22 extending outwardly for actuating the various control or stopping mechanisms of the yarn processing station.

At this stage, the valves $V_1$, $V_2$, and $V_3$, all shown in FIG. 2 in their switching settings I, are now all in their switching settings II.

An operator or automatic device may now carry out at the yarn processing station the various servicing procedures which are necessary to restore the yarn processing station to operation. These servicing procedures generally include reinserting the yarn Y into the yarn guide eyelet 1 of the yarn sensor 5. During these servicing procedures the yarn sensor may be moved, either temporarily or permanently, to its operative setting as the yarn is threaded into the yarn guide eyelet 1. However, this has no effect upon the control valves or upon the switching mechanism 21, and the piston rod 22 remains in the outward setting for effecting the stopping of the various devices which are controlled thereby. This is so because in the switching setting II of the multiway valve $V_1$, the connection to the line 54 is blocked, and the control line 55 is vented through the air outlet 64.

After the necessary servicing procedures have been carried out, regardless of the duration of these servicing procedures, the switching elements 62 is reset into its original setting as shown in FIG. 2. This causes the simultaneous closing of the air outlet 64 and the switching of the reservoir control valve $V_3$ into its switching setting I by means of the plunger 65.

Closing of the air outlet 64 permits the pressure in the control line 54 to build up and to thus act upon the larger control face 58 of the control valve $V_2$, switching it over to the switching setting I of FIG. 2. The pressure chamber of the switching mechanism 21 is, in this switching setting I of the control valve $V_2$, vented through the line 59 and a relevant valve bore, so that the piston rod 22 is retracted inwardly under the influence of the restoring spring 60, thus disengaging the stopping mechanisms which are associated with this switching mechanism 21. The yarn processing station is thus reactivated or restarted. During the start-up of the two-for-one twisting spindle, the tension in the yarn or in the yarn balloon is also slowly built up again. Upon restarting of the yarn processing station as the yarn tension gradually builds, the operative connection between the yarn sensor and the switching mechanism is temporarily interrupted or overridden for a preselected period of time. Thus, even if the yarn tension is insufficient for maintaining the yarn sensor 5 in its operative setting in which the pressure outlet 52 is blocked, no further switching off signals are transmitted by the yarn sensor 5 to the switching mechanism 21. This is so because the volume of the compressed air in the pressure reservoir 67 is still adequate for maintaining the multiway valve $V_1$, via the larger control face 70, in the switching setting II. The pressure in the pressure reservoir 67 drops slowly, because of the provision of the restrictor element 68 and an appropriate venting hole provided in the control valve $V_3$ in the switching setting I. Preferably, the restrictor 68 is so adjusted that the compressed air drop occurs over a period of about five seconds.

The illustrated apparatus thus insures that, in the case of a two-for-one twisting spindle, for example, there does not occur an inadvertent and thereby undesirable actuation or triggering of the switching element 21 during the running up of the spindle assembly from the stopped condition to normal operating speed. Only when the pressure in the pressure reservoir 67 has dropped to a predetermined relatively low level, inadequate to provide sufficient force on the larger control face 70 to overcome the opposing force on the smaller control face, will the multiway valve $V_1$ be restored into the switching setting I by the compressed air supplied through the line 71. After this has taken place, a yarn breakage or the absence of the yarn in the yarn guide eyelet 1 will again bring about an opening of the pressure outlet 52, producing a switching over of the control valve $V_2$ into the switching setting II, and as a result of which the above-described control or working cycle is carried out again.

While FIG. 2 shows the control circuit of this embodiment of the invention in a diagrammatic or schematic manner, FIGS. 3–6 provide a more detailed illustration of a preferred construction for this embodiment of the invention, in various switching or operative settings.

The embodiment in accordance with FIGS. 3–6 comprises a valve housing made up substantially of three sections 72, 73 and 74. As seen in the side elevational view of FIG. 3*a*, these sections of the valve housing are held together by suitable means, such as four screws 75. Diaphragms 76 and 77 are fitted between the several housing sections. The diaphragms 76 and 77 have apertures so as to provide at least one continuous line or passageway through the respective sections 72, 73, 74 forming the valve housing. The housing sections 72, 73, 74 have valve body spaces, storage spaces, duct sections and the like, whose arrangement and relative disposition to one another will be understood most clearly from the following description of the mode of operation of the apparatus shown in FIGS. 3–6. In the following description, elements which have been previously described with reference to FIG. 2 will be identified by the same reference characters, wherever applicable, in order to avoid repetitive description.

Figure 3:
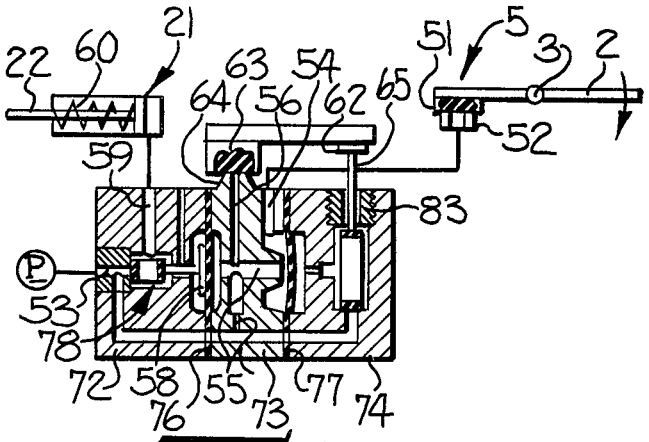
FIGS. 3, 4, 5 and 6 are sectional views of a preferred construction for a yarn monitoring mechanism in accordance with the control circuit of FIG. 2.
Figure 3A:
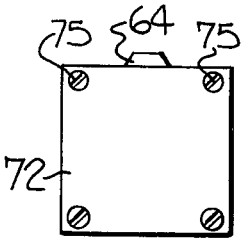
FIG. 3*a* is a side elevational view of a portion of the apparatus shown in FIGS. 3–6.

FIG. 3 illustrates the situation which exists during the normal operation of the yarn processing station when the yarn sensor is held by the yarn in its normal operative setting in which the pressure outlet 52 is blocked. The second pressure outlet 64 is similarly blocked by means of a seal 63 held by the switching element 62. Compressed air is supplied through the line 53 from the compressed air source P to the section 72 of the housing. This line 53 continues through the longitudinally and laterally running duct and hole sections to the line 54 leading to the pressure outlet 52. The thus supplied compressed air acts through the control line 55 located in the middle housing section 73 onto one side of the diaphragm 76, by which a valve body 78, corresponding substantially to the differential pressure control valve $V_2$ in FIG. 2, is maintained in a setting such that the connection between the input line 53 and the line 59 leading to the switching mechanism 21 is interrupted. The valve body 78, controlled by differential pressure, is positioned with its larger control face 58 abutting against the rear face of the diaphragm 76, while its smaller control face is directly subjected to the compressed air supplied through the input line 53. The throttle or restrictor 57 is in a section of the line leading to the lines 54 and 55.

Figure 4:
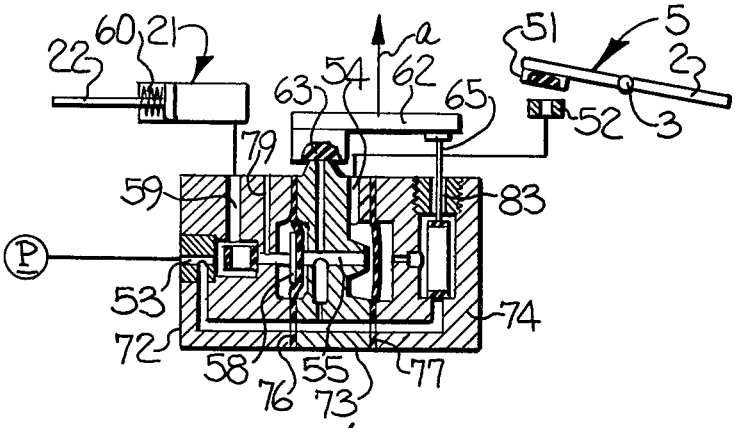

FIG. 4 shows the situation which exists when a yarn breaks. In this event, the shaft or holding rod 2, no longer held by the yarn in its operative setting, pivots in such a way that the air outlet 52 is opened, producing a pressure drop in the lines 54 and 55. The diaphragm 76, and thereby the larger control face 58 of the valve body 78, are then no longer subject to pressure so that the compressed air supplied through the line 53 and acting upon the opposite smaller control face of the valve body 78 is in a position to reset the valve body 78 so as to produce a connection between the line 53 and line 59 leading to the switching mechanism 21. Resetting of the valve body 78 simultaneously interrupts the connection between the line 59 and a venting line 79 for the switching mechanism. When compressed air is directed to the switching mechanism, the piston rod 22 is moved outwardly, and as a result, for example, the spindle of the yarn processing station is stopped and it is also possible to trigger other control sequences.

Figure 5:
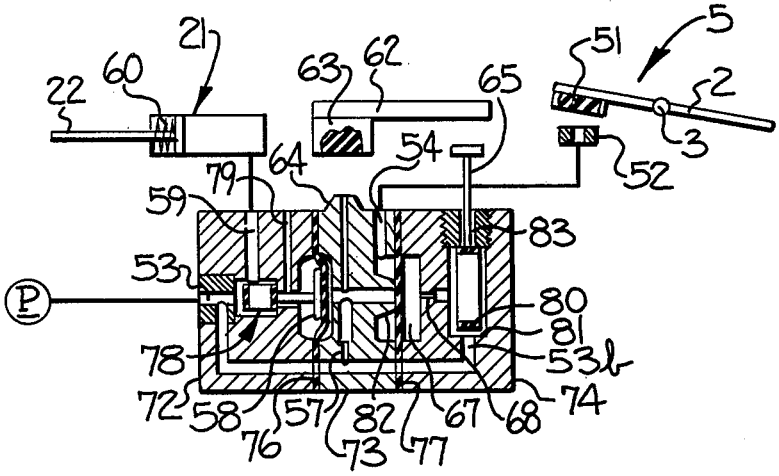

Subsequently, the operator or some automatic device resets the switching element 62 in the direction of the arrow a from the setting shown in FIG. 4 to the setting shown in FIG. 5, which causes opening of the pressure outlet 64. The plunger 65 attached to a valve body 80 is released at the same time. This valve body 80 performs, in conjunction with a valve seat 81, substantially the same function as the reservoir control valve $V_3$ of FIG. 2. The valve seat 81 defines the end of the line 53*b*, which is connected through the line 53 to the compressed air source P.

The valve body 80 is lifted by the pressure present in line 53*b* from the valve seat 81 upon the release of the plunger 65 by the switching element 62. This opens an access to the pressure reservoir 67 through and adjoining throttle or restrictor 68. This reservoir 67 is formed by a recess in the housing section 74 and is closed on one side by the diaphragm 77 between the two housing sections 73 and 74. This diaphragm is pressed by the compressed air entering the pressure reservoir against a valve seat 82, as a result of which the connection between the line 54 leading to the air outlet 52 and the pressure supply line 53 is interrupted. The resetting of the valve body 80 into the position freeing the valve seat 81 interrupts at the same time the connection between the pressure reservoir 67 and a venting hole 83.

In conjunction with the valve seat 82, the diaphragm 77 performs substantially the same function as is performed in accordance with the embodiment of FIG. 2 by the multiway valve $V_1$ in its switching setting II, i.e. the connection between the pressure source P and the pressure outlet 52 associated with the yarn sensor is interrupted, while the line 53 is vented via the throttle or restrictor 57 through the then-opened pressure outlet 64, whereby the larger control face 58 of the valve body 78 is simultaneously relieved. It is thus possible to carry out service and maintenance operations, for example in the area of the yarn sensor, since in the situation shown in FIG. 5 the operation of the various control devices controlled by the switching mechanism 21 is not affected when the pressure outlet 52 is blocked, intermittently or for variously long periods of time, as might occur during the threading up of a yarn through the yarn guide eyelet 1. So long as the switching element 62 is in the released setting as shown in FIG. 5, the switching mechanism 21 will remain actuated with the piston rod 22 thereof in the outwardly extended position.

Figure 6:
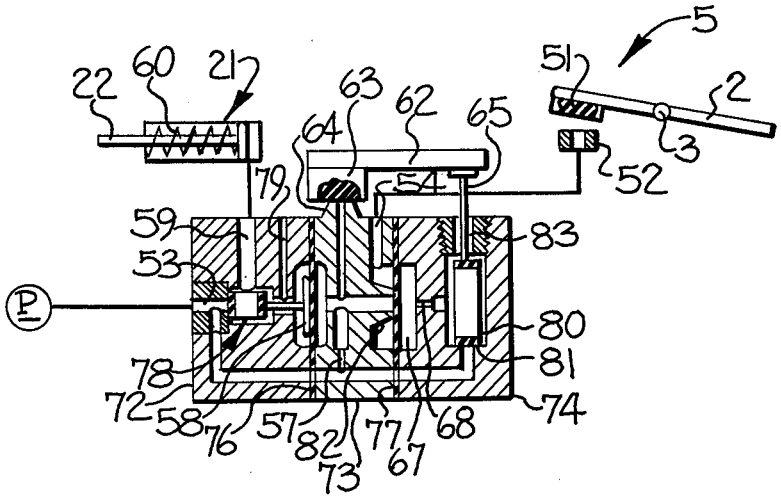

Following the completion of the necessary service or maintenance operations, such as for example the threading through and knotting together of the yarn and the application of the yarn to a take-up package, the yarn processing station or two-for-one twisting spindle may be reactivated by resetting the switching element 62 back to its normal or starting position as shown in FIGS. 3 and 6. As a result of the resetting of the switching element 62, the pressure outlet 64 is closed and the valve body 80, through the plunger 65, is made to seat against the valve seat 81. Because of the throttle or restrictor 68, the pressure reservoir 67 is vented through the venting hole 83 slowly over a predetermined period of time, and the diaphragm 77 remains in the setting in which the valve seat 82 is closed until the predetermined period of time has elapsed so that a pressure can build up behind the throttle or restrictor 57, which pressure acts through the diaphragm 67 onto the larger control face 58 of the valve body 78 so that this valve body 78 is returned to its original setting in which the connection between the line 53 and the line 59 leading to the switching mechanism 21 is interrupted. During this time, a connection is made between the line 59 and the venting line 79 so that the piston rod 22 is restored to its starting position under the action of the spring 60.

The line leading to the air outlet 52 remains isolated from the line 53 leading from the compressed air source P as a result of the delayed venting of the pressure reservoir 67 through the restrictor or throttle 68 in the venting hole 83, so that variations in tension in the yarn balloon during the restarting of the spindle assembly will not trigger a control command causing a further stopping of the spindle through the switching mechanism 21.

After a short time, when the yarn tension has gradually built up again to a level sufficient to hold the yarn sensor in its operative setting, the pressure reservoir 67 will again be adequately vented so that the diaphragm 77 is lifted from the associated valve seat 82 and the connection between the pressure line 53 and the line 54 leading to the pressure outlet 52 is again made. The yarn sensor is then fully functional and the situation shown in FIG. 3 has been restored.

Figure 7:
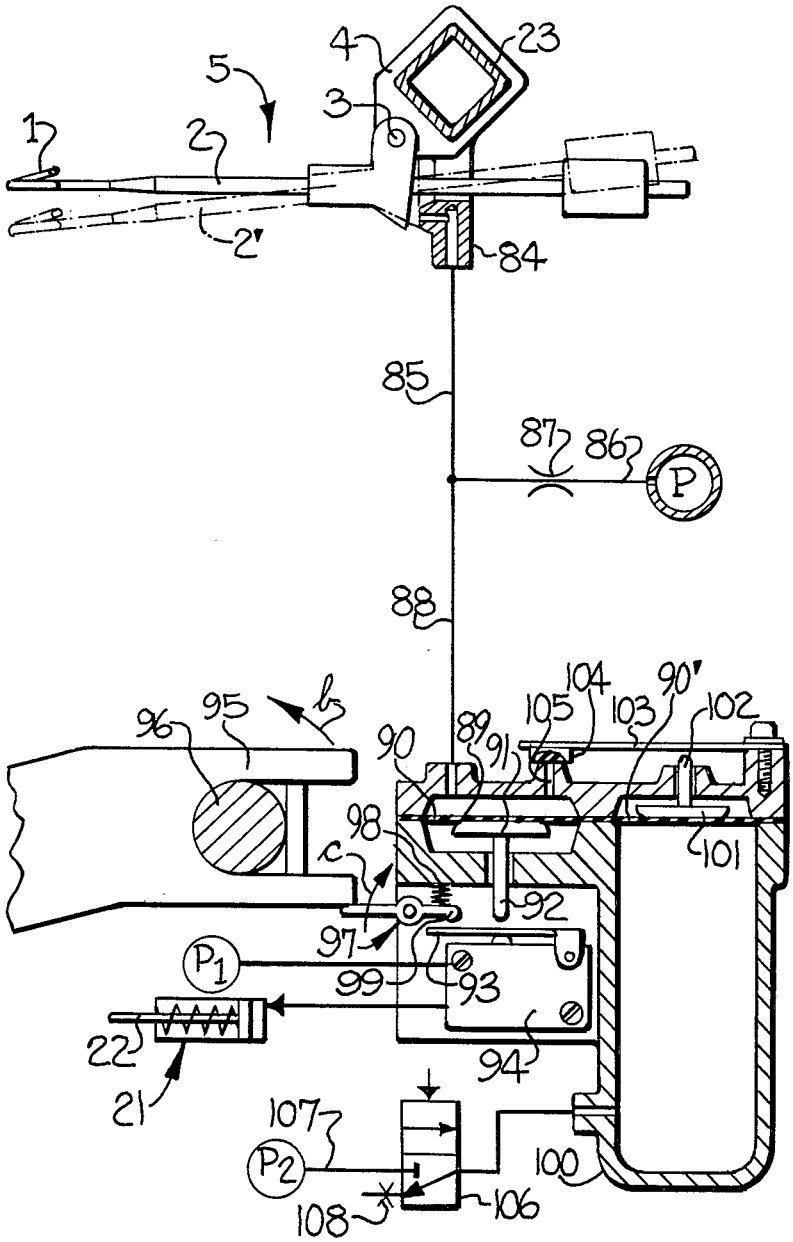
FIG. 7 is a diagrammatic drawing, partially in section, of a yarn monitoring mechanism in accordance with a further embodiment of the invention and showing a yarn sensor of a two-for-one twister yarn processing station.

In accordance with a further embodiment of the invention, as illustrated in FIG. 7, the yarn sensor 5 is attached to a square tube 23 forming a part of the machine frame, with the shaft or holding rod 2 being pivotable about a pivot shaft 3. A pressure outlet 84 is so associated with the yarn sensor 5 that this outlet is open when the yarn sensor is in its proper operative setting, which is shown in FIG. 6 in solid lines. The pressure outlet 84 is connected through lines 85, 86 to a compressed air source P such as a compressed air main. A throttle or restrictor 87 is located in the line 86.

When the yarn sensor is held by the running yarn in its proper operative setting, the compressed air supplied from the compressed air source may freely emerge from the pressure outlet 84 as a relatively feeble air jet. In the event of a yarn breakage or the like, the shaft 2 of the yarn sensor mechanism 5 will pivot into the setting 2' shown in FIG. 7 in dot-dash lines in which the pressure outlet 84 will be blocked. This results in a build-up of pressure in the supply line 85 and thereby also in a pressure chamber 89 connected through a branch line 88 to the line 85. The pressure chamber 89 is blocked on one side by a diaphragm 90. Upon the build-up of pressure in the pressure chamber 89, a piston 91 is depressed by the diaphragm 90. A shank 92 of this piston 91 acts upon an actuating lever 93 of a pneumatic valve 94. A compressed air source $P_1$, otherwise identical to the compressed air source P, is connected through actuation of the pneumatic valve 94 to the switching mechanism 21 as a consequence of which the piston rod 22 is advanced outwardly to thus actuate various control mechanisms, as for example a spindle brake for stopping the two-for-one twisting spindle or to trigger some other switching sequence. In this way there can be made effective, via the yarn sensor mechanism, an operational device such as a spindle stopping unit, a yarn stopping unit, or a friction drive roll arresting unit.

A mechanical setting lever 95 is swiveled in the direction of the arrow b around a stationary shaft 96 in order to carry out various servicing operations on the immobilized yarn processing station of two-for-one twisting spindle. This causes a two-armed lever 97 to be pivoted in the direction of the arrow c under the actuation of a setting spring 98. The free end 99 of the two-armed lever 97 is thus depressed and engages the actuating lever 93 of the pneumatic valve 94 for maintaining valve 94, independently of the setting of the piston 91 or the piston shank 92, in the switching setting in which the switching mechanism 21 is acted upon by compressed air from the compressed air source $P_1$.

The operator can then carry out the necessary servicing operations at the yarn processing station or two-for-one twisting spindle, which activities include the pivoting of the yarn sensor during the threading of the yarn through the yarn guide eyelet 1. The pressure outlet 84 may be opened one or more times as a result of these servicing operations, so that it may happen that the pressure space 89 is vented and the piston 91 is consequently released. Since, however, the lever 97 is pivoted under the action of the setting spring 98 in the direction of the arrow c, as previously described, the lever 97 continues to maintain the actuating lever 93 of the pneumatic valve in the depressed setting so that the switching mechanism 21 will continue to be acted upon by compressed air.

A further switching sequence is triggered by the operator or an automatic service device in the course of the further servicing or maintenance operations for the purpose of connecting the pressure reservoir 100 to a compressed air source $P_2$, which may, by way of example, be one of the two above-mentioned compressed air sources P or $P_1$. Thus, for example, as illustrated in FIG. 7, a valve 106 is provided in the line 107 leading from the pressure source $P_2$ to the pressure reservoir 100. Valve 106 is normally positioned in a first setting in which the portion of the line 107 extending from the pressure source $P_2$ is blocked and the portion of the line 107 extending from the pressure reservoir 100 is vented through a restriction or throttle 108. Upon the actuation thereof, the valve 106 may be positioned in a second setting in which the pressure source $P_2$ is connected directly to the pressure reservoir 100. The pressure reservoir 100 is closed on one side by an enlarged section 90' of the diaphragm 90. A piston 101 is associated with this diaphragm section 90' in such a way that the shank portion 102 of the piston is moved outwardly, i.e. upwardly as viewed in FIG. 7, upon the pressurization of the pressure reservoir 100. The outward movement of the piston shank 102 is instrumental in lifting a closure member, preferably in the form of a leaf spring 103, out of blocking engagement with a venting hole 109 provided in the pressure chamber 89. The leaf spring 103 is clamped at one end, and the free end thereof carries a seal 104 for sealing the venting hole 105.

The pressure build-up in the pressure reservoir 100 thus acts through the diaphragm section 90', the piston 101, the piston shank 102, and the leaf spring 103 upon the seal 104 which is raised from its setting in which it blocks the venting hole 105, so that the pressure space 89 is vented.

When the setting lever 95 is released and returned to its original setting upon the completion of the servicing procedures at the yarn processing station, the double-armed lever 97 will likewise be pivoted back into its original position against the force of the setting spring 98, and as a result the connection between the compressed air source $P_1$ and the switching mechanism 21 is interrupted. The yarn processing station or two-for-one twisting spindle may now be restarted. With the restarting of the yarn processing station, the yarn tension will gradually build up at the yarn sensor. During this gradual build-up of tension, the pressure outlet 84 may remain closed for a period of time until the yarn tension builds to a sufficient level, or the pressure outlet may be intermittently opened and closes in the event of an oscillating motion of the yarn sensor due to varying yarn tension. Since, however, the pressure chamber 89 is still vented through the venting hole 105, pressure cannot be built up within the pressure chamber even with the air outlet 84 blocked, and thus the piston 91 and piston shank 92 will produce no further actuation of the pneumatic valve 94.

With the restart of the yarn processing station or spindle, the valve 106 is simultaneously reset, either manually or automatically, from a setting in which the pressure source $P_2$ is connected to the pressure reservoir 100, to its normal setting in which the pressure source $P_2$ is blocked and the pressure reservoir 100 is vented through a restriction or throttle 108, and the pressure within the pressure reservoir 100 will slowly drop over a predetermined period of time. When the pressure within the reservoir 100 drops to a sufficient level, the piston 101 and piston shank 102 will be retracted, thus permitting the seal 104 to again block the venting hole 105. The time delay required for this to take place spans the time required for the yarn tension to build up to its normal level sufficient to maintain the yarn sensor in its operative setting.

The delayed closing of the venting hole 105 thus insures that, for example, in the case of a two-for-one twisting spindle, there occurs no inadvertent and thereby undesirable triggering of the switching mechanism 21 on the renewed spindle start-up.

Figure 8:
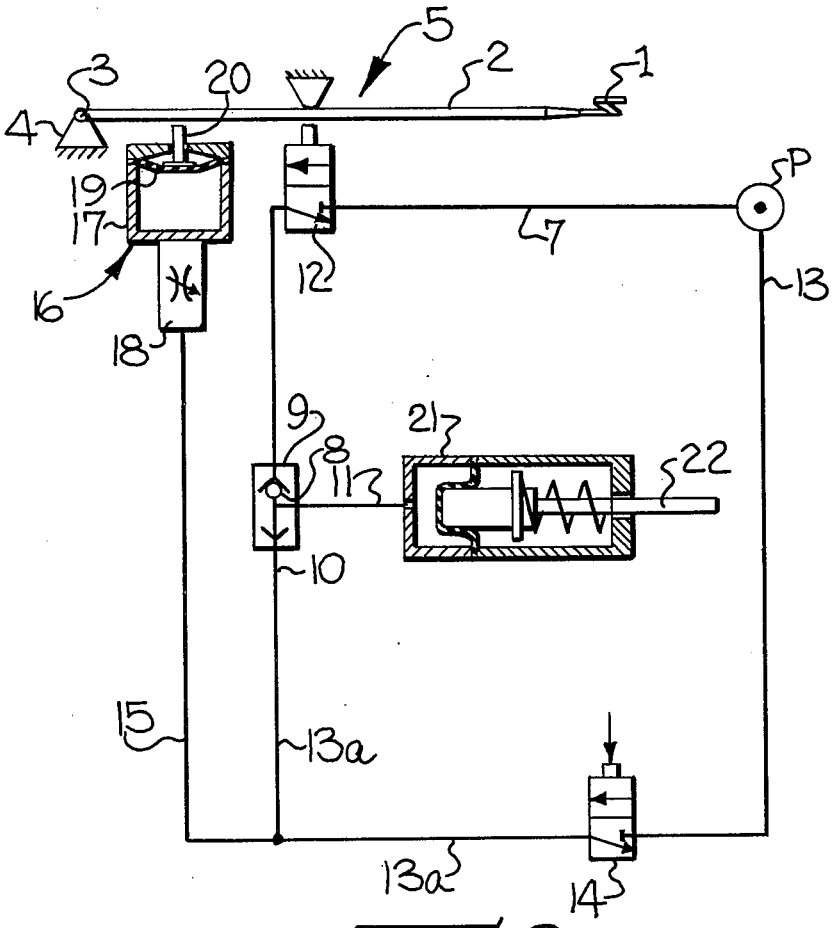
FIG. 8 is a schematic drawing of a further embodiment of a yarn monitoring mechanism constructed in accordance with the invention.

The embodiment of the invention shown in FIG. 8 comprises a pneumatic circuit including a compressed air pressure source P to which is connected a first pressure line 7, 7*a* leading to a first inlet 9 of a bidirectional control valve 8. As illustrated, the valve 8 is of the type adapted to receive pressure from one of two inlets 9, 10 and to discharge the same through a single outlet. Located in the line 7, 7*a* is a directional control valve 12, more particularly a 2/2 directional control valve acting as a switching means actuable by the yarn sensor. A second pressure line 13, 13*a* is also connected to the compressed air source P and leads to the second inlet 10 of the control valve 8. Located in the pressure line 13, 13*a* is a second bidirectional control valve 14, in particular a 2/2 directional control valve. To the outlet from the bidirectional control valve 14 is connected, through the line section 13*a*, a branch line 15 which leads to a pneumatically actuable time delay holding means, generally indicated at 16, which includes a pressure cylinder or box 17, on the input side of which there is provided a control element 18. The pressure cylinder or box 17 is partitioned by a diaphragm 19 into a pressure chamber connected to the compressed air source P through the control element 18 and a piston chamber for accommodating a piston 20. The control element 18 comprises a restrictor which is so constructed as to permit substantially instantaneous pressurization of the pressure cylinder 17 when pressure is supplied in the line 15 so as to thus permit substantially instantaneous movement of the piston 20 from its rest position out of engagement with the yarn sensor to a holding position for engaging and holding the yarn sensor in its operative setting. Upon venting of the line 15, the restrictor 18 permits a delayed depressurization of the pressure cylinder 17 so as to thereby provide a delayed return of the piston 20 from its holding position to its rest position over a predetermined period of time.

The outlet 11 of the valve 8 is connected to the switching mechanism 21 controlling the operation of the textile machine yarn processing station and constituting the actuating means proper from which are derived the various functions which influence the operation of the yarn processing station.

The pressure source P may either be pneumatic or hydraulic, a compressed air source normally being preferable because textile machinery is frequently already equipped with compressed air sources of this kind. In the case of a pneumatic control circuit, the control means 18 preferably comprises an orifice or a combined throttle and nonreturn valve which is specifically suitable for a hydraulic circuit.

When a yarn breakage occurs or the yarn tension falls off, the downward movement of the yarn sensor from its operative setting to its released setting will first result in actuating the first control valve 12. As a result, compressed air is directed through the inlet 9 and the outlet 11 of the control valve 8 and to the switching mechanism 21. The switching mechanism may act through the piston rod 22 and possibly through further mechanical means (not shown) onto an assembly which, by way of example could in the case of a two-for-one twisting spindle be a spindle stop device, a spindle brake, a bobbin frame device, a device for stopping the friction drive roll of the take-up mechanism, and so forth.

Through a manual operation or an automatic device, the second control valve 14 is then operated. As a result, compressed air will pass first through the second inlet 10 and the outlet 11 of the control valve 8 and into the switching mechanism 21 to thereby hold it in the actuated condition with the piston rod 22 thereof extended. Additionally, the operation of the guide 14 will also direct compressed air through the control means 18 and into the pressure chamber of the pressure box or cylinder 17, causing, via the diaphragm 19, the piston 20 to be moved from its rest position to its holding positon so as to thereby engage the shaft or rod 2 and to return and hold the yarn sensor in its operative setting. This causes relief of the first control valve 12 which, as a result, is free to return to the blocking and venting setting shown in FIG. 8.

It is now possible for an operator or some automatic device to perform the necessary service procedures at the yarn processing station whereby the yarn is also reinserted into the yarn guide eyelet 1 of the yarn sensor. During such service procedures, the second control valve 14 remains in the flow-through setting so that both the pressure chamber 17 and the switching mechanism 21 remain pressurized.

After the service procedures are completed, the control valve 14 is returned to its original blocking and venting setting, so that the switching mechanism 21 is vented through the line section 13*a* and a venting duct located within the control valve 14. Upon return of the piston rod 22, the yarn processing station or two-for-one twisting spindle is reactivated, whereby yarn tension builds up slowly during the running up of the spindle. Even if this yarn tension is not initially sufficient to maintain the yarn sensor in its operative setting, further actuation of the switching mechanism 21 will be prevented because the pressure in the pressure cylinder or box 17 still maintains the piston 20 in its outward holding setting thus engaging the shaft 2 and maintaining the yarn sensor in an operative setting. The pressure within the pressure cylinder 17 drops gradually, for example within a preferred time period of about five seconds.

This will insure that when the yarn processing station or two-for-one twisting spindle is restarted, inadvertent and undesired triggering of the valve 12 and thus the switching mechanism 21 will not occur for a predetermined period of time, sufficient for the yarn processing station or twisting spindle to return to a normal stabilized operating condition.

Figure 9:
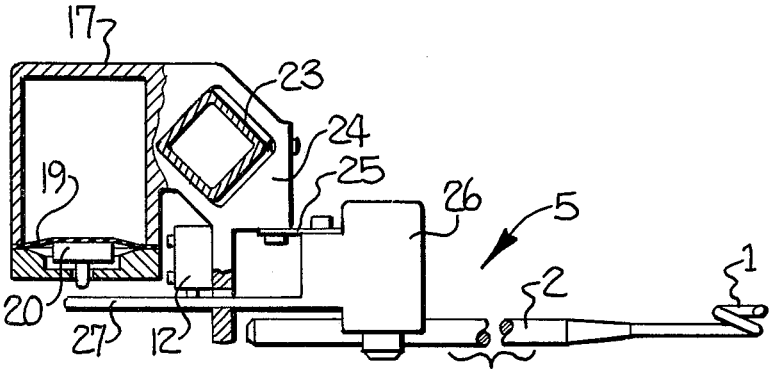
FIG. 9 is a side view, partially in section, of a preferred construction for the yarn sensor for use in the embodiment of FIG. 8.

FIG. 9 shows a preferred construction of the apparatus schematically illustrated in FIG. 8. As illustrated, a holding element 24 is attached to a square tube 23 forming a part of the frame of the textile machine, to which element 24 is fixed a switching means corresponding to the first control valve 12 shown in FIG. 8. A leaf spring 25 having a preferred bending or folding line is also secured to the holding element 24. To the leaf spring 25 is fixed a holder 26 for the holding rod or shaft 2 for the yarn guide eyelet 1. To the holder 26 is attached a rod 27 which passes through an aperture provided in the holding element 24 and which is associated with the valve 12 in such a way that when the yarn sensor is pivoted downward in the event of a yarn breakage, the control valve 12 is operated in the manner described in connection with FIG. 8.

The pressure box or cylinder 17 is also carried by the holding element 24, with the diaphragm 19 and piston 20 located within the pressure chamber 17 in the manner previously described. The control valve 12 and the pressure chamber 17 are integrated into the control circuit in the above-described way, so that when the piston 20 is moved to its extended holding position upon the pressurization of the pressure chamber 20, the rod 27, forming a lever arm, is engaged and returns and holds the yarn sensor mechanism in its operative setting for a predetermined period of time.

Although the apparatus constructed in accordance with the present invention has been primarily described in conjunction with a two-for-one twister yarn processing machine, it should be understood that this apparatus may also be employed for a multiplicity of other textile machines in which it can be insured that the yarn has an adequate yarn tension during normal operation of the various yarn processing stations.

In the drawings and specification, there have been set forth preferred embodiments of this invention, and although specific terms are employed, they are used in a generic and descriptive sense only and not for purposes of limitation. What is claimed is:

1. In a textile yarn processing machine, such as a two-for-one twister or the like, having respective yarn processing stations, the combination therewith of an improved yarn monitoring system for stopping the operation of the yarn processing station in response to the absence of a yarn running therethrough, as for example, upon the occurrence of a yarn breakage, and constructed to avoid inadvertent and undesirable stopping of the yarn processing station upon restarting while the yarn processing station is returning to a normal operating condition, said yarn monitoring mechanism comprising a yarn sensor constructed and mounted so as to be held in an operative setting by yarn tension when the yarn is running in normal operating condition and to be released in the event of the release of such yarn tension;

a switching mechanism for stopping the operation of the yarn processing station;

means pneumatically connecting said yarn sensor to said switching mechanism for pneumatically actuating said switching mechanism upon the release of said yarn sensor from said operative setting including a pressure line connected to a pressure source and a pressure outlet at a terminal end of said pressure line and cooperating with said yarn sensor so that said outlet is blocked by said yarn sensor when said yarn sensor is in one of its operative or released settings and said outlet is open when said yarn sensor is in the other of its operative or released settings; and time delay means actuable upon restarting of the yarn processing station for permitting a further actuation of said switching mechanism only after a predetermined period of time has elapsed, said time delay means including means interrupting the pneumatic connection of said yarn sensor to said switching mechanism, and a pressure reservoir having a restricted bleed opening for allowing the pressure level therein to slowly drop over a predetermined period of time and being connected to said means for interrupting the pneumatic connection of said yarn sensor to said switching mechanism for maintaining the pneumatic connection interrupted until the pressure in said pressure reservoir has dropped to a predetermined level.

2. The apparatus as set forth in claim 1 wherein said pressure outlet cooperates with said yarn sensor so as to be blocked when said yarn sensor is in its operative setting and open when said yarn sensor is in its released setting, and including a control valve cooperating with said pneumatically actuable switching mechanism and movable between an open and closed position for controlling the supply of pressure fluid to said switching mechanism, and including a control line connecting said control valve to said pressure line for actuating said control valve and moving the same from the closed position when said outlet is blocked and to the open position when said outlet is open.

3. The apparatus as set forth in claim 2 including a restrictor throttle located in said pressure line upstream of said outlet, and wherein said control valve comprises a differential pressure control valve having a larger control face communicating with said control line downstream of said restrictor throttle and a smaller control face connected directly to said pressure source.

4. The apparatus as set forth in claim 1 wherein said pressure outlet cooperates with said yarn sensor so as to be open when said yarn sensor is in its operative setting and blocked when said yarn sensor is in its released setting, and including means cooperating with said pneumatically actuable switching mechanism and with said pressure outlet and operable for directing a supply of pressure fluid to said switching mechanism upon the blocking of said outlet.

5. The apparatus as set forth in claim 4 wherein said means for directing a supply of pressure fluid to said switching mechanism upon the blocking of said outlet comprises a pressure chamber communicating with said pressure line and having a pressure-actuated movable piston therein, a valve located adjacent to said pressure chamber and cooperating therewith so as to be actuable upon the pressurizing of said pressure chamber as a result of the blocking of said outlet, and means connecting said switching mechanism to said pressure source through said valve for supplying pressure fluid to said switching mechanism upon the actuation of said valve.

6. The apparatus as set forth in claim 1 including a reservoir control valve cooperating with said pressure reservoir and with a pressure source for connecting the reservoir to said pressure source, said reservoir control valve being movable between a first setting for causing venting of the pressure fluid through said restricted bleed opening and a second setting providing a connection between said pressure source and the reservoir while preventing venting of the reservoir.

7. The apparatus as set forth in claim 6 including an externally actuable switching element cooperating with said reservoir control valve for normally maintaining said reservoir control valve in its first setting, and being operable upon actuation for permitting movement of said reservoir control valve to said second setting.

8. The apparatus as set forth in claim 7 wherein said reservoir control valve is biased by said pressure source toward said second setting, and wherein said externally actuable switching element is normally positioned to cooperate with said reservoir control valve for overcoming said bias and holding said reservoir control valve in said first setting, and said switching element being operable upon the release thereof for releasing said reservoir control valve and permitting movement thereof to said second setting.

9. The apparatus as set forth in claim 8 including a second pressure outlet positioned for cooperating with said externally actuable switching element so as to be blocked thereby when said switching element is in its normal position maintaining said reservoir control valve in its first setting with said pressure reservoir being vented, and including a further control valve having two switchable settings, said further control valve including means operable when said valve is in its first setting for providing connection among said pressure source, said pressure air outlet associated with said yarn sensor, said line acting upon the larger control face of said differential pressure control valve, and said second pressure air outlet; and including means operable when said valve is in its second setting for providing connection among said pressure source, said line acting upon the larger control face of said differential pressure control valve, and said second pressure outlet.

10. In a textile yarn processing machine, such as a two-for-one twister or the like, having respective yarn processing stations, the combination therewith of an improved yarn monitoring system for stopping the operation of the yarn processing station in response to the absence of a yarn running therethrough, as for example, upon the occurrence of a yarn breakage, and constructed to avoid inadvertent and undesirable stopping of the yarn processing station upon restarting while the yarn processing station is returning to a normal operating condition, said yarn monitoring mechanism comprising a yarn sensor constructed and mounted so as to be held in an operative setting by yarn tension when the yarn is running in normal operating condition and to be released in the event of the release of such yarn tension;

a fluid actuated, switching mechanism for stopping the operation of the yarn processing station;

means operably connecting said yarn sensor to said switching mechanism for actuating the switching mechanism upon the release of said yarn sensor from said operative setting; and time delay means actuable upon restarting of the yarn processing station for permitting a further actuation of said switching mechanism only after a predetermined period of time has elapsed, said time delay means comprising a pressurized fluid actuated, movable piston cooperating with said yarn sensor and movable between a rest position out of engagement with said yarn sensor and a holding position for engaging and holding said yarn sensor in its operative setting, a fluid pressure cylinder mounting said piston and for maintaining said piston in the holding position for a predetermined period of time following the restarting of the yarn processing station, a pressure fluid circuit communicatively connected to and controlling said switching mechanism, said piston and said cylinder, and control means communicatively connected to said fluid circuit and to said pressure cylinder and operable for permitting substantially instantaneous pressurization of said pressure cylinder when said pressure fluid circuit is pressurized to thus permit substantially instantaneous movement of said piston, while permitting a delayed relief of pressure in said pressure cylinder when said pressure fluid circuit is depressurized for thus permitting a delayed return movement of the piston to its rest position over a predetermined period of time.

11. The apparatus as set forth in claim 10 wherein said pressure cylinder includes a diaphragm partitioning the cylinder into a pressure chamber connected to said pressure medium circuit and a piston chamber accommodating said piston.

12. The apparatus as set forth in claim 10 wherein said pressure fluid comprises compressed air, and said control means comprises a restrictor.

13. In a textile yarn processing machine, such as a two-for-one twister or the like, having respective yarn processing stations, each including means forming a rotating balloon of running yarn during the processing of the yarn and a yarn guide eyelet for limiting the upper end of the rotating balloon of yarn during passage of the running yarn therethrough, the combination therewith of an improved yarn monitoring system for stopping the operation of the yarn processing station in response to the absence of a yarn running therethrough, as for example, upon the occurrence of a yarn breakage, and constructed to avoid inadvertent and undesirable stopping of the yarn processing station upon restarting while the yarn processing station is returning to a normal operating condition, said yarn monitoring mechanism comprising a yarn sensor cooperating with said yarn guide eyelet and mounted so as to be held in an operative setting by the tension of the yarn running through said eyelet and to be released in the event of the release of such tension;

a pressure source;

a first pressure line connected at one end to said pressure source and terminating at a first pressure outlet, said first pressure outlet cooperating with said yarn sensor so as to be blocked when said yarn sensor is in its normal operative setting and open upon the release of said yarn sensor in the event of yarn breakage, and said pressure line having a restrictor throttle therein located between said pressure source and said first pressure outlet;

a differential pressure actuated control valve having a passageway therethrough and including means movable between a first setting in which said passageway is blocked and a second setting in which said passageway is open, said differential pressure actuated control valve having a relatively large control face and a relatively small control face, and including a first control line connecting said large control face to said first pressure line downstream of said restrictor throttle and a second control line connecting said smaller control face directly to said pressure source so that said differential pressure actuated control valve is moved into said first setting when said first pressure outlet is blocked and said yarn sensor is in its normal operative setting and is moved into said second setting when said first pressure outlet is open upon the release of said yarn sensor in the event of yarn breakage;

a pneumatically actuable switching mechanism for stopping the operation of the yarn processing station, and including means connecting said switching mechanism to said pressure source through said differential pressure actuated control valve so that said switching mechanism is actuated when said valve is in said second setting and the passageway therethrough is open and said switching mechanism is released when said valve is in its first setting with the passageway therethrough closed;

a pressure reservoir;

a reservoir control valve connected to said pressure reservoir and to said pressure source and being movable between a first setting and which said pressure reservoir is vented through a restricted bleed opening for allowing the pressure level in said pressure reservoir to slowly drop over a predetermined period of time, and a second setting in which said pressure reservoir is connected to said pressure source while venting of the reservoir is prevented, and including means biasing said reservoir control valve toward said second setting;

an externally actuable switching element cooperating with said reservoir control valve and normally positioned for engaging said valve and maintaining the same in said first setting, said switching element being operable upon the release thereof for releasing said reservoir control valve and permitting movement thereof to said second setting;

a second pressure line connected at one end to said pressure source and terminating at a second pressure outlet, said second pressure outlet cooperating with said externally actuable switching element so as to be blocked thereby when said switching element is in its normal position maintaining said reservoir control valve in its first setting and to be open when said switching element is released;

a further control valve having two switchable settings, and including means operable when said valve is in its first setting for providing connection among said pressure source, said first pressure outlet associated with said yarn sensor, said first control line acting upon the larger control face of said differential pressure control valve, and said second pressure outlet; and including means operable when said valve is in its second setting for providing connection among said pressure source, said first control line acting upon the larger control face of said differential pressure control valve and said second pressure outlet;

said control valve having a relatively large control face and a relatively small control face, and including means connecting the larger control face to said first pressure line downstream of said restrictor throttle, and including means connecting the smaller control face to said pressure reservoir, and said control faces being so arranged that said control valve is maintained in its second setting when said pressure reservoir is pressurized and is shifted to said first setting a predetermined period of time following the restarting of the yarn processing station when the pressure in said pressure reservoir has dropped to a predetermined level, thereby preventing further actuation of said switching mechanism until said predetermined period of time has elapsed.

14. The apparatus as set forth in claim 13 comprising a further valve means for controlling the flow of pressure fluid from said pressure source to said pressure outlet, said further valve means being movable between a first setting providing a connection between said pressure source and said pressure outlet and a second setting interrupting this connection, and including means normally positioning said valve means in its first setting and operable for moving the same to said second setting in response to the pressurizing of said pressure reservoir.

15. The apparatus as set forth in claim 14 wherein said further valve means comprises a flexible diaphragm forming a wall of said pressure reservoir and constructed so as to be flexed from said first setting to said second setting by the pressurizing of said pressure reservoir.

16. In a textile yarn processing machine, such as a two-for-one twister or the like, having respective yarn processing stations, each including means forming a rotating balloon of running yarn during the processing of the yarn and a yarn guide eyelet for limiting the upper end of the rotating balloon of yarn during passage of the running yarn therethrough, the combination therewith of an improved yarn monitoring system for stopping the operation of the yarn processing station in response to the absence of a yarn running therethrough, as for example, upon the occurrence of a yarn breakage, and constructed to avoid inadvertent and undesirable stopping of the yarn processing station upon restarting while the yarn processing station is returning to a normal operating condition, said yarn monitoring mechanism comprising a yarn sensor cooperating with said yarn guide eyelet and mounted so as to be held in an operative setting by the tension of the yarn running through said eyelet and to be released in the event of the release of such tension;

a pressure source;

a pressure line connected at one end to said pressure source and terminating at a pressure outlet, said pressure outlet cooperating with said yarn sensor so as to be open when said yarn sensor is in its normal operative setting and blocked upon the release of said yarn sensor in the event of yarn breakage;

a pressure chamber having a pressure actuated movable piston therein;

a valve located adjacent to said pressure chamber and cooperating therewith so as to be actuable by said piston upon application of pressure to said pressure chamber;

a branch line communicatively connected to said pressure line and to said pressure chamber for pressurizing said pressure chamber upon the blocking of said pressure outlet as a result of a yarn breakage;

a pneumatically actuable switching mechanism for stopping the operation of the yarn processing station, said switching mechanism being pneumatically connected to said pressure source through said valve so that pressure is supplied to said switching mechanism from said pressure source upon the actuation of said valve, a venting hole provided in said pressure chamber;

means cooperating with said venting hole for normally closing said venting holes so as to permit pressure to build up in said pressure chamber upon the blockage of said pressure outlet; and means for opening said venting hole following a yarn breakage and for maintaining said venting hole open for a predetermined period of time following the restarting of the yarn processing station to thus prevent further pressurization of said pressure chamber until said predetermined period of time has elapsed, thereby allowing the yarn processing station to resume a normal stabilized operating condition and to thus avoid inadvertent and undesirable actuation of the switching mechanism prior to reaching such stabilized operating condition.

17. The apparatus as set forth in claim 16 including an externally actuable lever cooperating with said valve and operating independently of said piston for engaging and holding said valve in an actuated condition, and said lever normally being positioned out of engagement with said valve but being adapted for actuating said valve and thus maintaining said switching means in an actuated condition following a yarn breakage and during the restarting procedure.

18. The apparatus as set forth in claim 16 wherein said means cooperating with said venting hole for normally closing the same comprises a closure element normally biased toward and into blocking engagement with said venting hole for closing the same, and wherein said means for opening said venting hole and maintaining it in an open condition for a predetermined period of time comprises a pressure reservoir, a pressure actuated piston actuable upon pressurization of said reservoir for engaging said closure element and moving the same out of blocking engagement with said venting hole, and means for pressurizing said pressure reservoir and for allowing the pressure level therein to slowly drop over a predetermined period of time upon restarting of the yarn processing station so as to thereby permit further actuation of said switching mechanism only after the pressure has dropped to a predetermined level and said predetermined period of time has elapsed.

19. The apparatus as set forth in claim 18 wherein said closure element comprises a leaf spring.

20. In a textile yarn processing machine, such as a two-for-one twister or the like, having respective yarn processing stations, each including means forming a rotating balloon of running yarn during the processing of the yarn and a yarn guide eyelet for limiting the upper end of the rotating balloon of yarn during passage of the running yarn therethrough, the combination therewith of an improved yarn monitoring system for stopping the operation of the yarn processing station in response to the absence of a yarn running therethrough, as for example, upon the occurrence of a yarn breakage, and constructed to avoid inadvertent and undesirable stopping of the yarn processing station upon restarting while the yarn processing station is returning to a normal operating condition, said yarn monitoring mechanism comprising a yarn sensor cooperating with said yarn guide eyelet and mounted so as to be held in an operative setting by the tension of the yarn running through said eyelet and to be released in the event of the release of such tension;

a pneumatically actuable switching mechanism for stopping the operation of the yarn processing station;

a pressure source;

a bidirectional control valve having first and second inlets and a single outlet, and including means connecting said outlet to said pneumatically actuable switching mechanism;

a first pressure line connecting said pressure source to said first inlet of said control valve, and including a first valve located in said pressure line for controlling the flow of air therethrough, said first valve cooperating with said yarn sensor so as to be actuated upon release of said yarn sensor from its operative setting and to permit flow of air to said switching means when said yarn sensor is in its released setting and to block the flow of air when said yarn sensor is in its operative setting;

a second pressure line connecting said pressure source to said second inlet of said control valve and including a second valve located in said second pressure line for controlling the flow of air therethrough, said second valve being externally actuable for permitting the flow of air to said switching mechanism so as to thereby maintain said switching mechanism in an actuated condition while permitting resetting of said yarn sensor to its operative setting; and pneumatically actuable time delay holding means cooperating with said yarn sensor for engaging and holding said yarn sensor in its operative setting for a predetermined period of time following resetting thereof, said time delay holding means comprising a piston mounted for movement from a rest position out of engagement with said yarn sensor to a holding position for engaging and holding said yarn sensor in its operative setting, a pressure cylinder in which said piston is mounted, and a line connecting said pressure cylinder to the downstream side of said second valve for thereby supplying pressure to said pressure cylinder upon the opening of said second valve, and including a restrictor located in said line and operable for permitting substantially instantaneous pressurization of said pressure cylinder for thereby substantially instantaneously moving said piston from said rest position to said holding position upon the opening of said second valve, while permitting a delayed depressurization of said pressure cylinder following the closing of said second valve so as to thereby provide a delayed return of said piston from its holding position to its rest position over a predetermined period of time and thus prevent further actuation of said switching mechanism until said predetermined period of time has elapsed.

* * * * *